US006393680B1

(12) United States Patent
Chan

(10) Patent No.: US 6,393,680 B1
(45) Date of Patent: May 28, 2002

(54) METHOD FOR SETTING PRECIOUS GEMS IN JEWELRY THROUGH THE USE OF SCREWS AND OTHER STABILIZING MEANS

(75) Inventor: Vicki Chan, Hong Kong (HK)

(73) Assignee: Continental Jewelry (USA) Inc., New York, NY (US)

( * ) Notice: Subject to any disclaimer, the term of this patent is extended or adjusted under 35 U.S.C. 154(b) by 0 days.

(21) Appl. No.: 09/971,394

(22) Filed: Oct. 5, 2001

Related U.S. Application Data

(62) Division of application No. 09/447,037, filed on Nov. 19, 1999.

(51) Int. Cl.[7] ..... B23P 5/00
(52) U.S. Cl. ..... 29/10; 29/896.41; 29/896.412
(58) Field of Search ..... 29/10, 896.41, 29/896.411, 896.412; D11/91, 92

(56) References Cited

U.S. PATENT DOCUMENTS

| | | | |
|---|---|---|---|
| 1,971,265 | A | 8/1934 | King |
| 2,079,043 | A | 5/1937 | Samstag |
| 2,132,905 | A | 10/1938 | Maynier |
| 2,316,225 | A | 4/1943 | Hoffman et al. |
| 3,483,716 | A | 12/1969 | Stenzler |
| 3,626,718 | A | 12/1971 | Schneider |
| 3,905,848 | A | 9/1975 | Williams |
| 4,748,728 | A | 6/1988 | Magnien et al. |
| 4,813,246 | A | 3/1989 | Richards |
| 5,056,337 | A | 10/1991 | Nhaissi |
| 5,099,660 | A | 3/1992 | Dostourian |
| 5,343,718 | A | 9/1994 | Poll |
| 5,423,196 | A | 6/1995 | Pollack |
| 5,524,458 | A | 6/1996 | Buchner |
| 5,682,768 | A | 11/1997 | Nissenbaum |
| 5,765,398 | A | 6/1998 | Bardisbanyan |
| 5,848,539 | A | 12/1998 | Ouzounian |
| 5,873,265 | A | 2/1999 | Simonnet |
| 6,116,054 | A | 9/2000 | Czupor |

FOREIGN PATENT DOCUMENTS

| | | |
|---|---|---|
| CH | 683489 | 3/1994 |
| EP | 44254 | 1/1982 |

*Primary Examiner*—P. W. Echols
(74) *Attorney, Agent, or Firm*—Stephen E. Feldman, P.C.

(57) ABSTRACT

A method and apparatus for setting gems in jewelry through the use of screws. More particularly, precious gems are set in a cavity of a jewelry piece comprising gems holes, screw holes and grooved slots. Gems are positioned in the cavity with four gems surrounding each gem hole. A screw is used to secure the gems in the cavity of the jewelry. The present invention may be implemented in jewelry such as rings, earrings, bracelets, lockets and the like.

4 Claims, 3 Drawing Sheets

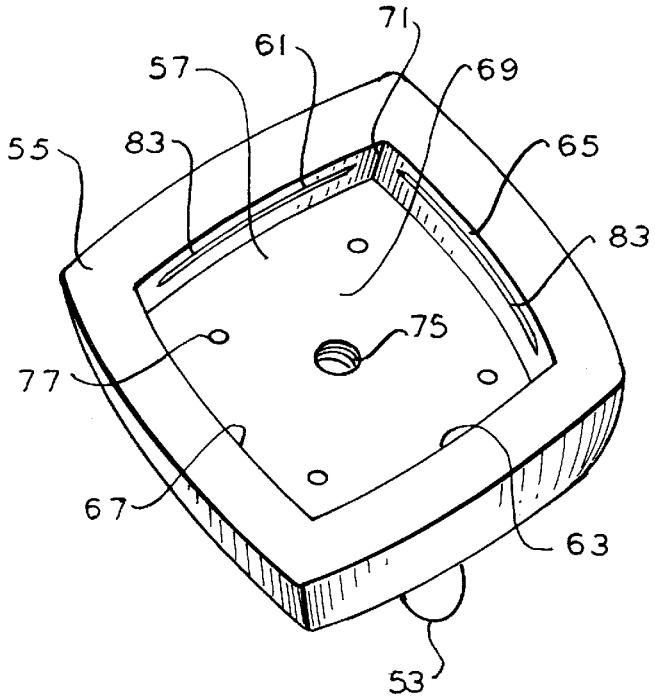
FIG. 5
FIG. 6
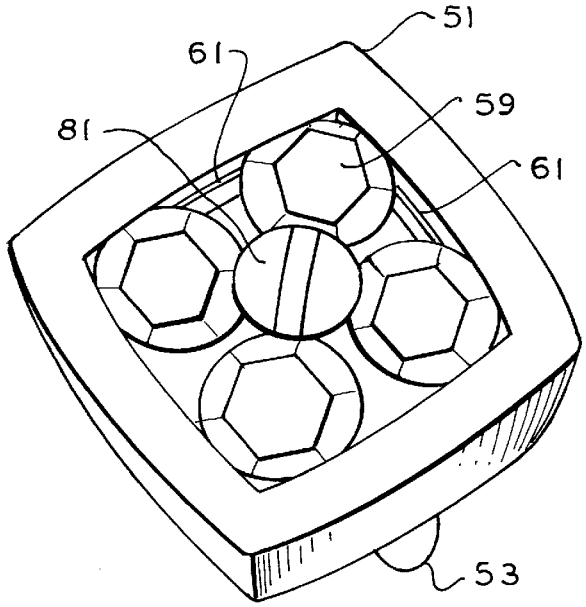
FIG. 7
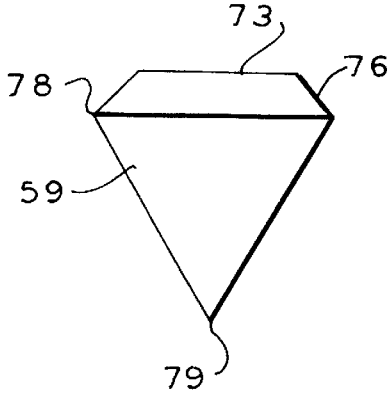
FIG. 8
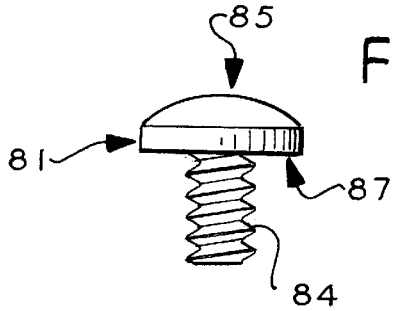

METHOD FOR SETTING PRECIOUS GEMS IN JEWELRY THROUGH THE USE OF SCREWS AND OTHER STABILIZING MEANS

This application is a divisional application of application Ser. No. 09/447,037 filed Nov. 19, 1999.

FIELD OF THE INVENTION

This invention is directed to a method and apparatus for setting gems, such as diamonds, in jewelry by using screws to secure the gem to the jewelry. The jewelry may be in many forms, including, but not limited to, rings, earring, bracelets, necklaces and other kinds of jewelry. The jewelry contains a cavity consisting of various openings and grooved slots. Edges of the gems are positioned in the openings and grooved slots so that they may be securely set in the jewelry. Screws are used to securely set the gems in the jewelry.

BACKGROUND OF THE INVENTION

There is a variety of well known apparatus and methods for setting gems in jewelry. However, these methods and apparatus present several problems. There is a long felt need for a more effective method and apparatus for setting gems in jewelry while maintaining the jewelry's aesthetic integrity.

U.S. Pat. No. 2,132,905 to Maynier discloses a stone setting device for jewelry or other applications. Maynier discloses a system of setting gems in a "frustrum like cup" shaped bezel. Screws are used to assist in securing the gems to the bezel. A substantial portion of the gem rests in the bezel. The gem is supported mainly by the bezel rather than by the screw. Unlike the present invention, the screw is used for the sole purpose of securing the gem to the bezel. The screw does not provide any support to the gem.

Maynier's stone setting device is problematic for several reasons. The frustrum shaped bezel is required to support the stone. The invention does not work without the bezel. Therefore, the arrangement of stones in jewelry is limited to the design of the bezel. The bezel and the gem must be of substantially similar shapes for the invention to operate effectively. That is, both the bezel and the gem must be frustrum shaped. The bezel restricts the number of stones that may be set at a maximum of only two stones per screw.

Maynier's bezel contains metal rings for supporting the stone. Most metals, when combined with precious gems, reduces the overall quality and value of the gem. In other words, the Karat weight of the gem is reduced when it is combined with most metals. However, materials such as gold and silver will not reduce the quality and value of the gem. In Maynier, a substantial portion of the gem is in contact with the bezel and metal supports. The metal reduces the quality of the ring and the surface of the gem is at risk of being scratched by the bezel.

Gems, such as diamonds, will shine most when exposed to a sufficient amount of light. When light is blocked from a gem, the gem appears to be dull. Therefore, when setting gems in jewelry, it is imperative to provide an ample amount of light passageways within the jewelry piece so that the gems are exposed to a maximum amount of light. In Maynier, a bezel is used to set the gem. The bezel is quite large and contains several obstructions such as metal supports. These obstructions block off light from being exposed to the gem set in the bezel. Therefore, the gems set in the bezel do not shine brightly. As a result, the gems appear to be of poor quality, and in some instances, fake.

There is a long felt need for a method and apparatus for setting gems in jewelry with screws which avoids the problems of the Maynier patent. The present invention overcomes these problems.

While the known apparatus and methods for setting gems in jewelry are of interest, they do not address the particular need to set a plurality of gems in jewelry so that the gems are easily removable.

SUMMARY OF THE INVENTION

The present invention is directed toward a method and apparatus for setting a plurality of precious gems in jewelry through the use of screws. Generally, the jewelry consists of a cavity, at least one screw hole, at least four gem holes, and at least two grooved slots. A plurality of gems is positioned in the jewelry cavity so that the various edges of the gem rest in the gem holes and grooved slots. One screw is used to set four gems around the screw. The present invention may be implemented with many kinds of jewelry, including, but not limited to, rings, earrings, bracelets, lockets, and other kinds of jewelry.

The present invention overcomes the problems of the prior art. The apparatus of the present invention does not contain a bezel. Rather, a screw provides the main support to four gems. Stability is added to the gems through the use of very small gem holes and grooved slots. Unlike Maynier, the surfaces of the gems have very little contact with the jewelry. The quality and integrity of the gem is not compromised since metal is not used to set the gems. The screws may be gold or silver, and therefore, do not diminish the quality of the gem. Also, since there is no bezel, a substantial amount of light is permitted to enter the jewelry cavity. As a result, the gems shine brightly and maintain a pleasing appearance. As a result, the present invention solves the problems of Maynier.

In the present invention, the screw serves two purposes. First, the screw provides support to the gems to be set in the jewelry. Second, the screw is used to securely set the gems in the jewelry. Four gems may be set in the jewelry for each screw used. Since no bezel is used, the gems may be arranged in many different ways.

The main object of the present invention is to provide a simple and inexpensive method and apparatus for setting a plurality of precious gems in jewelry by using screws to secure the gems to the jewelry.

Another object of the present invention is to provide a method and apparatus for providing jewelry in which one type of gem may be easily removed and replaced with other types of gem.

Another object of the present invention is to provide a method and apparatus for setting at least four gems in jewelry with the use of one screw.

Another object of the present invention is to provide a method of securely setting gems in jewelry while maintaining the ability to easily and inexpensively remove the gems from one piece of jewelry and set that gem in a different piece of jewelry.

Another object of the present invention is to provide a method and apparatus for setting gems in jewelry with a screw while permitting the gems to be sufficiently exposed to light so that they may shine brightly.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which:

FIG. 5 is a perspective view of an earring implemented in the present invention.

FIG. 6 is a perspective view of the earring of FIG. 5 with gems set therein.

FIG. 7 is a perspective view of a gem to be set in jewelry of the present invention.

FIG. 8 is a perspective view of a screw to be used in the present invention.

DESCRIPTION OF THE PREFERRED EMBODIMENT

The present method and apparatus is of broad applicability to many technical fields for the production of an infinite variety of articles. For illustrative purposes only, a preferred mode for carrying out the inventive method will be described hereinafter in conjunction with the production of a jeweled article, namely, a ring.

Figure 1:
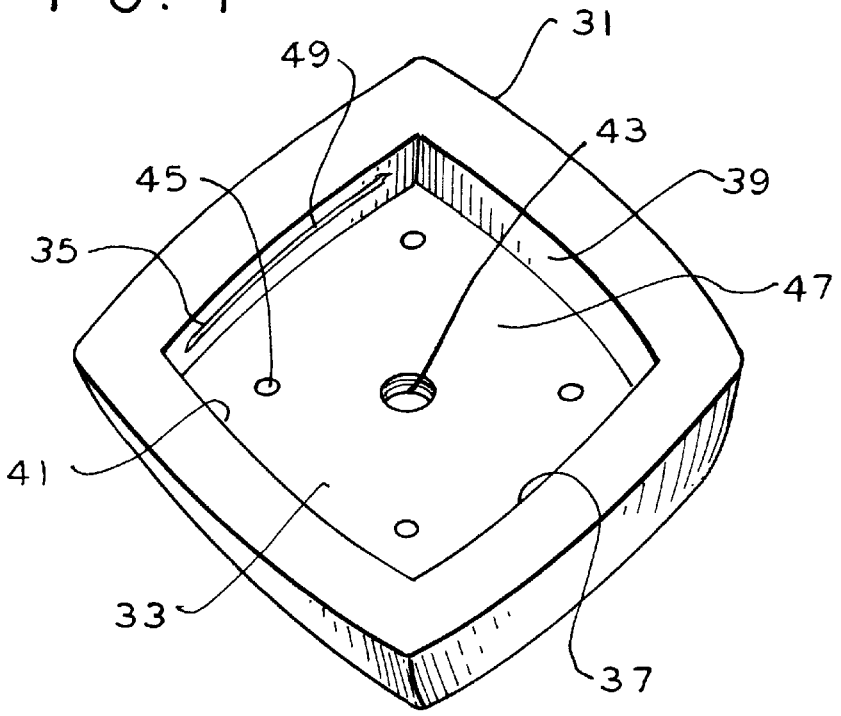
FIG. 1 is a perspective view of a cavity used in jewelry of the present invention.

The present invention is directed toward a method and apparatus for setting a plurality of gems in jewelry through the use of screws. The present invention may be implemented with many kinds of jewelry, including, but not limited to, rings, earrings, bracelets, lockets, and other kinds of jewelry. Referring to FIG. 1, the present invention includes a cavity 33, at least one screw hole 43, at least four gem holes 45, and at least two grooved slots 49. A plurality of gems is positioned in the jewelry cavity 33 so that the various edges of the gem rest in the gem holes 49 and grooved slots. Once the gems are set in place, a screw is used to securely set the gems in the jewelry. As will be shown below, the method and apparatus of the present invention should contain the elements described above for any type of jewelry.

The following description of the present invention is divided into three sections. The first section describes the present invention where the jewelry implemented is a ring. The second section describes the present invention where the jewelry implemented is an earring. As discussed herein, these are merely two of the many examples of the types of jewelry, such as bracelets and lockets that may be implemented. The third section describes the method implemented to practice the present invention.

I. SETTING GEMS IN A RING USING THE PRESENT INVENTION

Figure 2:
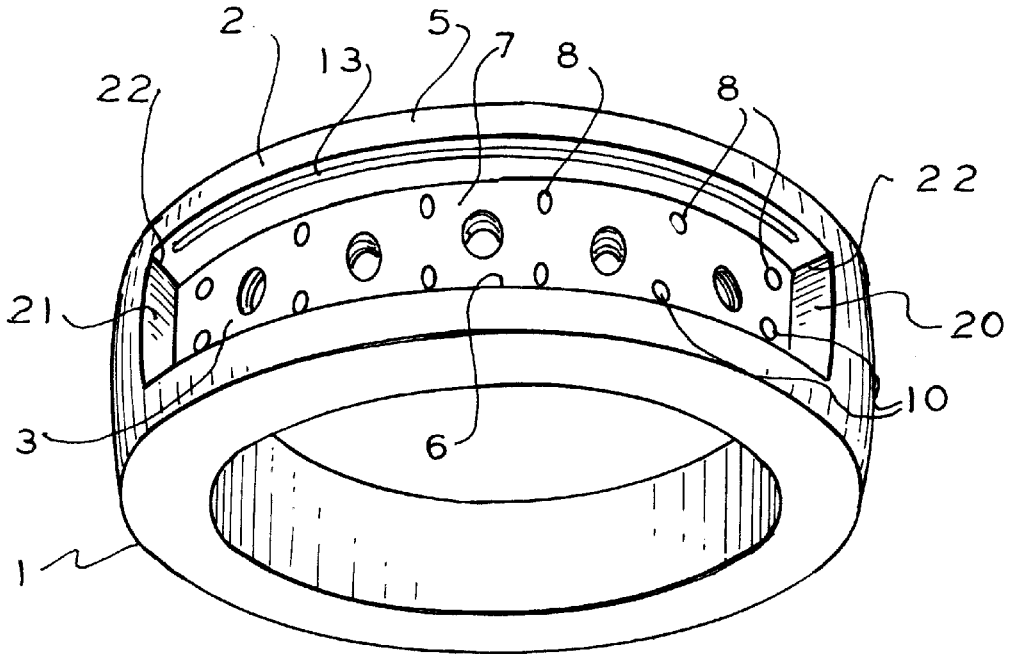
FIG. 2 is a perspective view of a ring implemented in the present invention.
Figure 3:
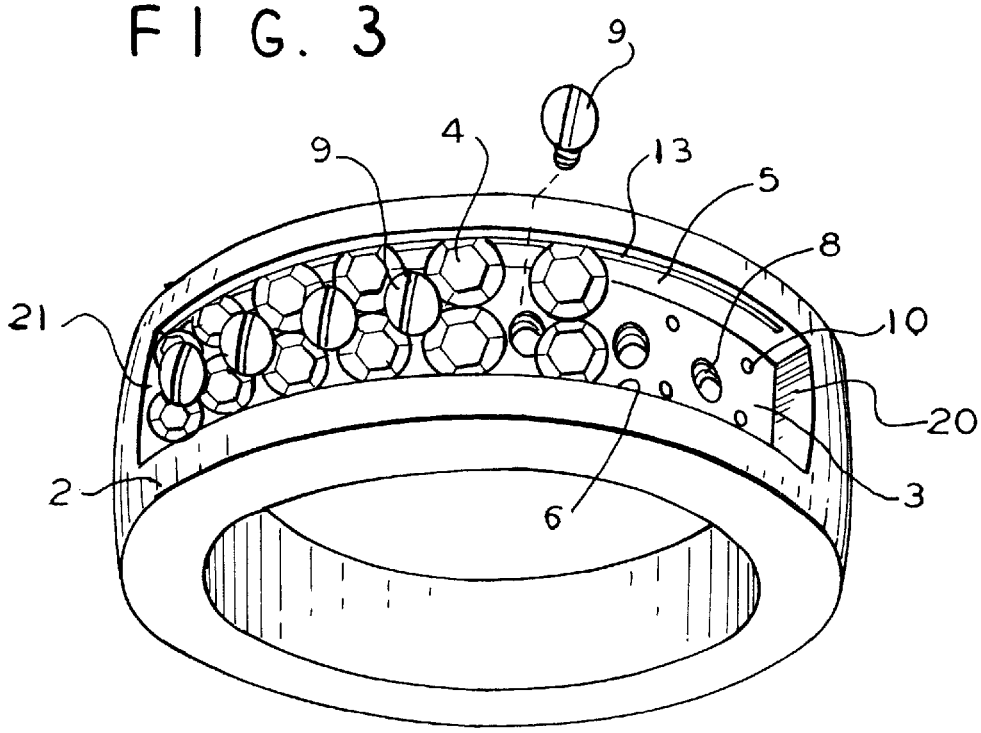
FIG. 3 is a perspective view of the ring FIG. 2 with gems set therein.
Figure 4:
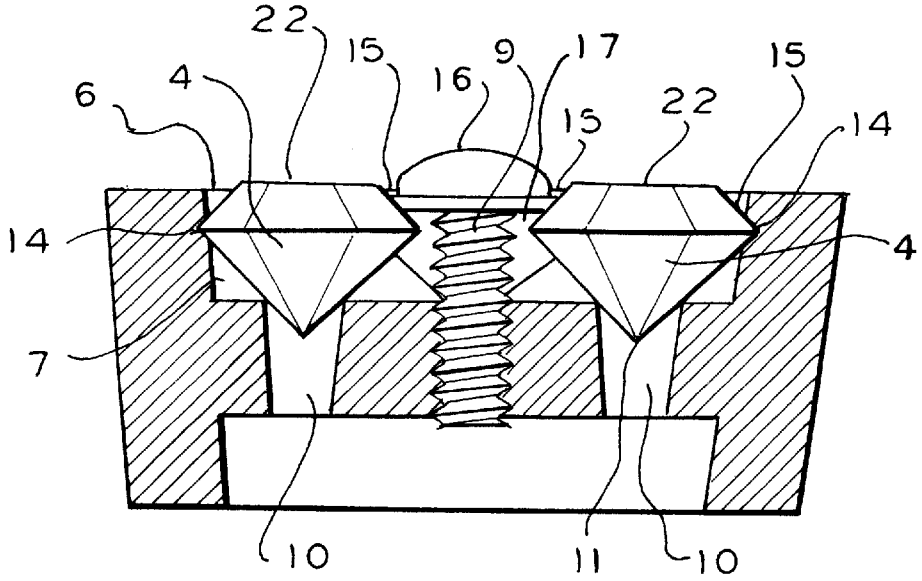
FIG. 4 is a cross sectional view of the ring of FIGS. 2 and 3.

Turning to the drawings wherein like reference numerals denote like parts, FIGS. 2, 3 and 4 illustrate a ring 1 on which gems may be set through the use of screws and other features. A ring 1 of any size or shape may be used for the present invention.

The following section materials are divided into three parts for ease of reading and understanding of the ring of the present invention. The section first describes the shape of the ring 1 and its dimensions. The section next describes various features that aid in setting the gems 4 in the ring 1. The final section describes the screws 9 used to securely set the gems 4 in the ring 1.

SHAPE AND DIMENSIONS OF THE RING

The following material is a detailed description of the size, shape and dimensions of the ring implemented in the present invention.

In one embodiment, a cylindrical ring is implemented. However, other shaped rings may be used, including, but not limited to a cylindrical ring with a square face, a round face, an oval face or other shaped faces. The face 2 of ring 1 consists of a cavity 3 for setting a plurality of gems 4. The ring 1, with cavity 3, may be made through the lost wax method (also known as investment casting). Preferably, gems 4 are precious gems. Precious gems include diamonds, emeralds, sapphires and rubies. However, other gems, such as semi-precious gems may be used as well. The cavity 3 consists of four walls and a base 7. A first wall 5, a second wall 6, a third wall 20 and a fourth wall 21 form the boundary of cavity 3 in which the gems 4 may be set. The edges of base 7 are connected to the bottom end of each wall, thereby forming cavity 3. Preferably, each corner 22 of cavity 3 is formed at an approximate right angle. However, each corner 22 may be formed at other angles.

The dimensions of cavity 3 vary according to several factors. The first wall 5 and second wall 6 should be of equal length and height, or of substantially equal length and height. Moreover, the particular length and height of the equal sized walls 5 and 6 may vary depending on the amount and size of the gems 4 to be set in ring 1. As the number of gems 4 to be set in ring 1 increases, the length of walls 5 and 6 increase. Similarly, as the size of jewel 4 increases, the length and height of first wall 5 and second wall 6 increases. Similarly, as the size of the gems 4 increases, the width of the walls 20 and 21 increases. Third wall 20 and fourth wall 21 should also be of equal length and height, or of substantially equal length and height. Base 7 may be of a sufficient depth so that the tops 22 of gems 4 rest approximately on the same level as the face 2 of ring 1. The first wall 5 and second wall 6 extend upward from the base 7 of cavity 3 to the face 2 of the ring 1.

FEATURES THAT AID IN SETTING GEMS IN THE RING

This section describes various features that aid in setting gems in the ring 1 of the present invention. More particularly, this section first describes various openings used for setting gems in the ring and then describes grooved slots used for adding support to the gems to be set in the ring.

Base 7 contains two types of openings. The first type of openings is screw holes 8 for receiving screws for setting the gems 4. The second type of openings is gem holes 10 for supporting apex 11 of the gems 4.

The first type of openings, screw holes 8, are threaded for receiving screws 9. The screw holes 8 are cut, by machining, through base 7. Screw holes 8 are cut all the way through base 7. Each screw hole 8 must be sufficiently spaced so that four gems 4 may be set around the screw hole 8. The spacing of the screw holes 8 will vary according to the size and number of gems 4 used. Furthermore, each screw hole should be cut at a point in base 7 that is approximately equidistant from first wall 5 and second wall 6. The diameter of the screw holes 8 may vary in size according to the size of the gems to be used. Typically, as the gem 4 to be set increases in size, the screw 9 also used to secure the gem increases in size. Therefore, screw hole 8 will increase in diameter as the gem increases in size. The number of screw holes 8 may vary in each ring according to the number of desired gems 4 to be set in ring 1. For example, ring 1 may consist of only one screw hole 8 where four gems 4 are to be set in ring 1. Turning to another example, ring 1 may consist of seven screw holes 8 where sixteen gems are to be set in ring 1. As shown by these examples, ring 1 may consist of any number of holes sufficient for setting a desired number of gems 4 per screw 9.

The second type of openings is gem holes 10. The gem holes 10 are cut, by machining, through base 7. Each gem hole 10 is of a sufficient depth so that the apex 11 of jewel 4 may rest in the gem hole. The gem holes 10 are cut through cavity 3 of ring 1. Each gem hole 10 must be sufficiently spaced apart from screw hole 8 so that four gems 4 may be set around screw hole 8. The spacing of gem holes 10 may vary according to the size and amount of gems to be set in ring 1. The diameter of the gem holes 10 may vary in size according to the size of the gem to be set. As the size of gems 4 increase, the size of gem holes 10 increase. For example, the diameter of gem hole 10 may be one sixteenth of an inch (1/16") when one karat diamonds are used. The amount of gem holes 10 may vary in each ring according to the number of screw holes 8 in ring 1. Each screw hole 8 must be surrounded by four gem holes 10. For example, ring 1 may consist of only one screw hole 8 with four gem holes 10. Turning to another example, ring 1 may consist of seven screw holes 8 with sixteen gem holes 10.

Grooved slots 13 are used for adding support and stability in setting gems 4 in ring 1. The first wall 5 and second wall 6 each contain a grooved slot 13 that extends over the length the wall. The grooved slot 13 may be formed in each wall by the lost wax method or by conventional machining. Gems 4 are positioned in the cavity 3 so that edge 14 of each of gems 4 rests in grooved slot 13 with apex 1 1 resting in gem hole 10. Each grooved slot 13 may vary in length according to the number of gems 4 to be set in ring 1. As the number of gems 4 to be set in ring 1 increase, so does the length of grooved slot 13. Similarly, as the size of the gems 4 increases, the height and depth of grooved slots 13 increases.

SCREWS ARE USED TO SECURELY SET GEMS IN THE CAVITY OF THE RING

The following section describes the screws used to secure the gems set in the ring of the present invention.

Referring to FIG. 2, screw 9 is used to set the gems 4 in ring 1. Preferably, the screw 9 is made of either gold or silver. However, the screw may be made of other materials. Preferably, the head 16 of screw 9 is rounded. However, head 16 may be of other shapes and sizes. Preferably, the bottom side 17 of head 16 is flat so that the screw may rest flat on surface 15 of jewel 4. However, bottom side 17 may be of other sizes and shapes. Screw 9 must be of the same diameter as screw hole 8. Screw 9 may vary in number according to the number of screw holes 8 in base 7. For example, if ring 1 contains seven screw holes 8, then seven screws 9 must be used. Likewise, if ring 1 contains only one screw hole 8, then one screw 9 must be used. The screws 9 may vary in length depending upon the size and type of jewel 4 to be set in ring 1. However, shaft 18 of screw 9 must be of a sufficient length to secure gem 4 to ring 1.

II. EARRING USING SAME METHOD

As previously discussed, the jewelry implemented may be of any suitable size and shape. The following is a description of a second embodiment, where the same method for gems is implemented with an earring. Any type of earring attachment means may be used for attaching the earring to an ear. Attachment means for securing an earring to ear are well known. For example, the attachment means may be an ear post with a clutch, an ear post with an omega back or other holding means.

The following section describes the physical structure of the earring of the present invention. This section first describes the shape of the ring and its dimensions. This section next describes various features that aid in setting the gems in the earring. The final section describes the screws used to securely set the gems in the earring.

SHAPE AND DIMENSIONS OF THE EARRING

The following material is a detailed description of the size, shape and dimensions of the earring implemented in the present invention.

Referring to FIGS. 5 and 6, earring 51 has an ear attachment means 53 and a square-like face 55. However, face 55 is not required to be a perfect square. Earring 51 may be of other shapes, such as a rectangle or circle. The earring 51, with cavity 57 is made by the well known lost wax method. Preferably, gems 59 are precious gems. Precious gems include diamonds, emeralds, sapphires and rubies. However, other gems, such as semi-precious gems may be used as well. The face 55 of the earring 51 consists of a cavity 57 for setting a plurality of gems 59. The cavity 57 consists of four walls and a base 69. A first wall 61, a second wall 63, a third wall 65 and a fourth wall 67 form the boundary of cavity 57 in which the gems 59 may be set. The edges of base 69 are connected to the bottom end of each wall, thereby forming cavity 57. Preferably, each corner 71 of cavity 57 is formed at an approximate right angle. However, each corner 71 may be formed at other angles.

The dimensions of cavity 57 vary according to several factors. The first wall 61 and second wall 63 should be of equal length and height, or of substantially equal length and height. Moreover, the particular length and height of the equal sized walls 61 and 63 may vary depending on the amount and size of the gems 59 to be set in earring 51. As the number of gems 59 to be set in earring 51 increases, the length of first wall 61 and second wall 63 increases. Similarly, as the size of gem 59 increases, the length and height of first wall 61 and second wall 63 increases. Third wall 65 and fourth wall 67 should also be of equal length and height, or of substantially equal length and height. Base 69 may be of a sufficient depth so that the tops 73 of gems 59 are approximately on the same level as the face 55 of earring 51. The first wall 61 and second wall 63 extend upward from the base 69 of cavity 57 to the face 55 of the earring 51.

FEATURES THAT AID IN SETTING GEMS IN THE EARRING

This section describes various features that aid in setting gems in the earring of the present invention. More particularly, this section first describes various openings used for setting gems in the ring and then describes grooved slots used for adding support to the gems to be set in the earring.

Base 69 contains two types of openings. The first type of openings is screw hole 75 for receiving screws for setting the gems 59. The second type of openings is gem holes 77 for supporting apex 79 of the gems 59.

The first type of openings, screw holes 75, are threaded for receiving screw 81. The screw holes 75 are cut, by machining, through base 69. Screw holes 75 are cut through base 69. The spacing of the screw holes 75 will vary according to the size and number of gems 59 used. Furthermore, each screw hole 75 should be cut at a point in base 69 that is substantially equidistant from first wall 61 and second wall 63. The diameter of the screw holes 75 may vary in size according to the size of the gems to be used. Typically, the larger the gem 59, the larger the screw hole 75.

Therefore, screw hole 75 will increase in diameter as the gems 59 increases in size. The number of screw holes 75 may vary in each earring according to the number of desired gems 59 to be set in that earring. For example, earring 51 may consist of only one screw hole 75 where four gems 4 are to be set in earring 1. Turning to another example, earring 51 may consist of two screw holes 75 where six gems are to be set in earring 51. As shown in the examples, earring 51 may consist of any number of screw holes 75 sufficient for setting a desired number of gems 59 per screw 81.

The second type of openings is gem holes 77. The gem holes 77 are cut, by machining, through base 69. Each gem hole 77 is of a sufficient depth so that the apex 79 of jewel 59 may rest in the gem hole. The gem holes are cut all the way through cavity 57 of earring 51. Each gem hole 77 must be sufficiently spaced apart from screw hole 75 so that four gems 59 may be set around screw hole 75. The spacing of gem holes 10 may vary according to the size and amount of gems to be set in earring 51. The diameter of the gem holes 77 may vary in size according to the jewel to be used. For example, the diameter of gem hole 77 may be one sixteenth of an inch (1/16") when one karat diamonds are used. The amount of gem holes 77 may vary in each earring 51 according to the number of screw holes 75 in earring 51. Each screw hole 75 must be surrounded by four gem holes 77. For example, earring 51 may consist of only one screw hole 75 with four gem holes 77.

Wall 61, wall 63, wall 65 and wall 67 each contains a grooved slot 83. The grooved slot 83 is used for adding support and stability in setting gems 59. The grooved slot 83 extends over the length of each respective wall. The grooved slot 83 is formed in each wall by the lost wax method. Gems 59 are positioned in the cavity 57 so that the edge 78 of each gem 59 rests in grooved slots 83 with apex 79 resting in gem hole 77. Each grooved slot 83 may vary in length according to the number of gems 59 to be set in earring 51. As the number of gems 59 to be set in earring 51 increases, so does the length of grooved slot 83. Similarly, as the size of the gems 59 increases, so does the height and depth of grooved slot increase.

SCREWS ARE USED TO SECURELY SET GEMS IN THE CAVITY OF THE EARRING

The following sections describes the screws used to secure set the gems in earring 51.

Referring to FIG. 8, screw 81 is used to set the jewel 59 in earring 51. Preferably, the screw 81 is made of either gold or silver. However, the screw may be made of other materials. Preferably, the head 85 of screw 81 is rounded. However, head 85 may be of other shapes and sizes. The bottom side 87 of head 85 is flat so that the screw may rest flat on surface 76 of jewel 59. However, bottom side 87 may be of other sizes and shapes. Screw 81 must be of the same diameter as screw hole 75. Screw 81 may vary in number according to the number of screw holes 75 in base 69. The screw 81 may vary in length depending upon the size and type of gem 59 to be set in earring 51. However, shaft 84 of screw 81 must be of a sufficient length to secure jewel 59 to earring 51.

III. METHOD FOR SETTING GEMS IN THE APPARATUS OF THE PRESENT INVENTION

The following section describes the method of setting gems in the apparatus described above. The method described may be applied to any type of jewelry. However, for ease of understanding, the method is first described in relation to ring 1 and then described in relation to earring 51.

In practice, the apparatus of the invention is implemented so that the gems 4 may be securely set in ring 1. The gems 4 are placed in cavity 3 of ring 1. Each gem 4 is positioned so that its apex 11 rests in gem hole 10. Each gem 4 is positioned so that side 14 of that gem is securely inserted into grooved slot 13. When four gems 4 are set in place so that they surround one screw hole 8, screw 9 is inserted into screw hole 8. The screw should be tightened until bottom side 17 is securely in contact with surface 15 of each respective gem 4. The screw may be tightened with a screwdriver or similar tool. This process should be repeated until all of the screw holes are filled with screws 9 and all of the gems 4 are securely set in ring 1.

Turning to the second embodiment, the apparatus of the invention is implemented so that the gems 59 may be securely set in earring 51. The gems 59 are placed in cavity 57 of earring 51. Each gem 59 is positioned so that its apex 79 rests in gem hole 77. Each gem 59 is positioned so that edge 78 of that jewel is securely inserted into grooved slot 61. When four gems 59 are set in place so that they surround one screw hole 75, screw 81 is inserted into screw hole 75. The screw should be tightened until bottom side 87 is securely in contact with surface 76 of each respective jewel 59. The screw may be tightened with a screwdriver or similar tool. This process should be repeated until all of the screw holes 75 are filled with screws 81 and all of the gems 59 are securely set in earring 51.

In the foregoing description of the invention, reference to the drawings, certain terms have been used for conciseness, clarity, and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

While the present invention has been described with reference to specific embodiments, it is understood that the invention is not so limited but rather includes any and all changes and modifications thereto which would be apparent to those skilled in the art and which come within the spirit and scope of the appended claims.

I claim:

1. A method for setting gems in jewelry through the use of screws comprising the steps of:

obtaining jewelry with a cavity comprising at least one screw hole, at least one set of gem holes surrounding each of said screw holes, and at least two grooved slots;

placing gems in each set of gem holes so that the gems surround each screw hole;

positioning each gem so the gem's edges rest securely in said grooved slots;

inserting a screw into each of said screw holes; and tightening said screw so that the gems are securely set in said jewelry.

2. The method of claim 1, wherein said set of gem holes is equal to four gem holes.

3. The method of claim 1, wherein said jewelry is a ring and the number of gems set in said ring is at least four.

4. The method of claim 1, wherein said jewelry is earrings and the number of gems to be set in said earrings is at least four.

* * * * *